United States Patent [19]

Gitchel

[11] 4,238,922

[45] Dec. 16, 1980

[54] PROCESS FOR THE PRODUCTION OF POWER FROM CRUDE FUELS CONTAINING HIGH CONCENTRATIONS OF SULFUR

[75] Inventor: Wayne B. Gitchel, Rothschild, Wis.

[73] Assignee: Sterling Drug Inc., New York, N.Y.

[21] Appl. No.: 38,299

[22] Filed: May 11, 1979

[51] Int. Cl.[3] ..... F02C 7/00

[52] U.S. Cl. ..... 60/39.05; 60/39.46 S

[58] Field of Search ..... 60/39.05, 39.46 S, 39.55; 44/1 SR; 210/63 R

[56] References Cited

U.S. PATENT DOCUMENTS

| | | | |
|---|---|---|---|
| 2,944,396 | 7/1960 | Barton et al. | 60/39.05 |
| 4,055,400 | 10/1977 | Stambough et al. | 44/1 SR |
| 4,092,125 | 5/1978 | Stambough et al. | 44/1 SR |
| 4,099,929 | 7/1978 | Tipper et al. | 44/1 SR |

*Primary Examiner*—Louis J. Casaregola

*Attorney, Agent, or Firm*—Wenderoth, Lind & Ponack

[57] ABSTRACT

A sulfur bearing fuel is wet oxidized in the presence of an alkaline earth metal carbonate, of which the corresponding sulfate is insoluble. Ash and sulfate salt blown down from the wet oxidation are reacted at high temperature with another portion of the same or a different fuel to reduce the sulfate to sulfide. Carbonation of an aqueous dispersion of the sulfide releases hydrogen sulfide which is converted to elemental sulfur. Carbonate precipitates and is recycled.

11 Claims, 2 Drawing Figures

PROCESS FOR THE PRODUCTION OF POWER FROM CRUDE FUELS CONTAINING HIGH CONCENTRATIONS OF SULFUR

The invention provides a process for the production of power from crude fuels having a high concentration of sulfur. According to the process, a crude sulfur bearing fuel is subjected to a wet oxidation process in the presence of a carbonate, of which the corresponding sulfate is insoluble. Ash and sulfate salt produced are blown down from the wet oxidation and are reacted at high temperature with a further portion of the same or a different fuel to reduce the sulfate to sulfide. Carbonation of an aqueous dispersion of the sulfide releases hydrogen sulfide which is converted by per se known means to elemental sulfur. Carbonate precipitates and is recycled.

BACKGROUND OF THE INVENTION

Increasing national energy requirements are rapidly depleting the reserves of higher grade carbonaceous fuels used in conventional power production. The use of cruder, high sulfur content fuels will become essential in the near future. Technology has developed for the refinement of such fuels to produce gaseous or liquid products which may be used in conventional power plants without substantial change in design and with minimal effect on the environment.

These refining processes, typified by coal gasification and coal liquification, while effective in producing high quality fuels are costly to install and operate.

One of the problems associated with the combustion of sulfur bearing fuels is the formation of volatile sulfur oxides. Many processes have been devised for suppressing these emissions by either mixing an alkaline carbonate an alkaline earth carbonate, or a mixture thereof with the fuel or scrubbing the stack gases with a slurry of the carbonate. While an effluent gas of acceptable quality can be obtained the methods suffer the disadvantage of requiring the transportation of enormous quantities of the alkaline carbonate or alkaline earth carbonates to the plant location and the disposition of an equal volume of sulfate salt.

Processes have been developed by which free and combined sulfur, such as pyritic, organic or elemental sulfur, in coal are removed to produce a low sulfur coal which can be burned for the production of power without causing air pollution due to sulfur dioxide emission. See U.S. Pat. Nos. 3,824,084 and 3,960,513. These processes involve producing a coal-water slurry which is contacted with air under conditions of heat and pressure. Combustion of the coal does not take place and the low sulfur coal is subsequently isolated. It is apparent that these procedures do not provide a unitary process by which a high sulfur carbonaceous fuel can be oxidized to produce power while concurrently removing the sulfur content thus avoiding adverse effects on the environment.

Processes for the wet oxidation of carbonaceous materials are known particularly for the elimination of waste materials. See U.S. Pat. Nos. 2,665,249 and 2,944,396. These known processes do not, however, provide the necessary technology for wet oxidation of high sulfur containing fuel for the production of usable power while concurrently removing the sulfur and avoiding pollution of the environment.

SUMMARY OF THE INVENTION

It is the objective of the present invention to economically produce power from crude high sulfur-containing fuel without causing pollution of the environment and without the necessity of supplying large quantities of additives.

A further object of the invention is to isolate the sulfur from the fuel as elemental sulfur which is the most commercially useful form.

These objectives are obtained by the process of this invention which consists of oxidizing a portion of a crude fuel in the presence of an alkaline earth metal carbonate by the wet oxidation method, separating the insoluble ash and sulfate salts, mixing this solid residue with a portion of the same or a different fuel, and subjecting this mixture to combustion with a fuel:air ratio adjusted to maintain a reducing atmosphere. The reducing reaction converts the sulfates to sulfides which on reaction with carbon dioxide and water regenerates the alkaline earth metal carbonate and releases hydrogen sulfide as a gas. Well developed processes are available for conversion of the hydrogen sulfide to elemental sulfur.

DETAILED DESCRIPTION OF THE INVENTION AND DRAWING

Figure 1:
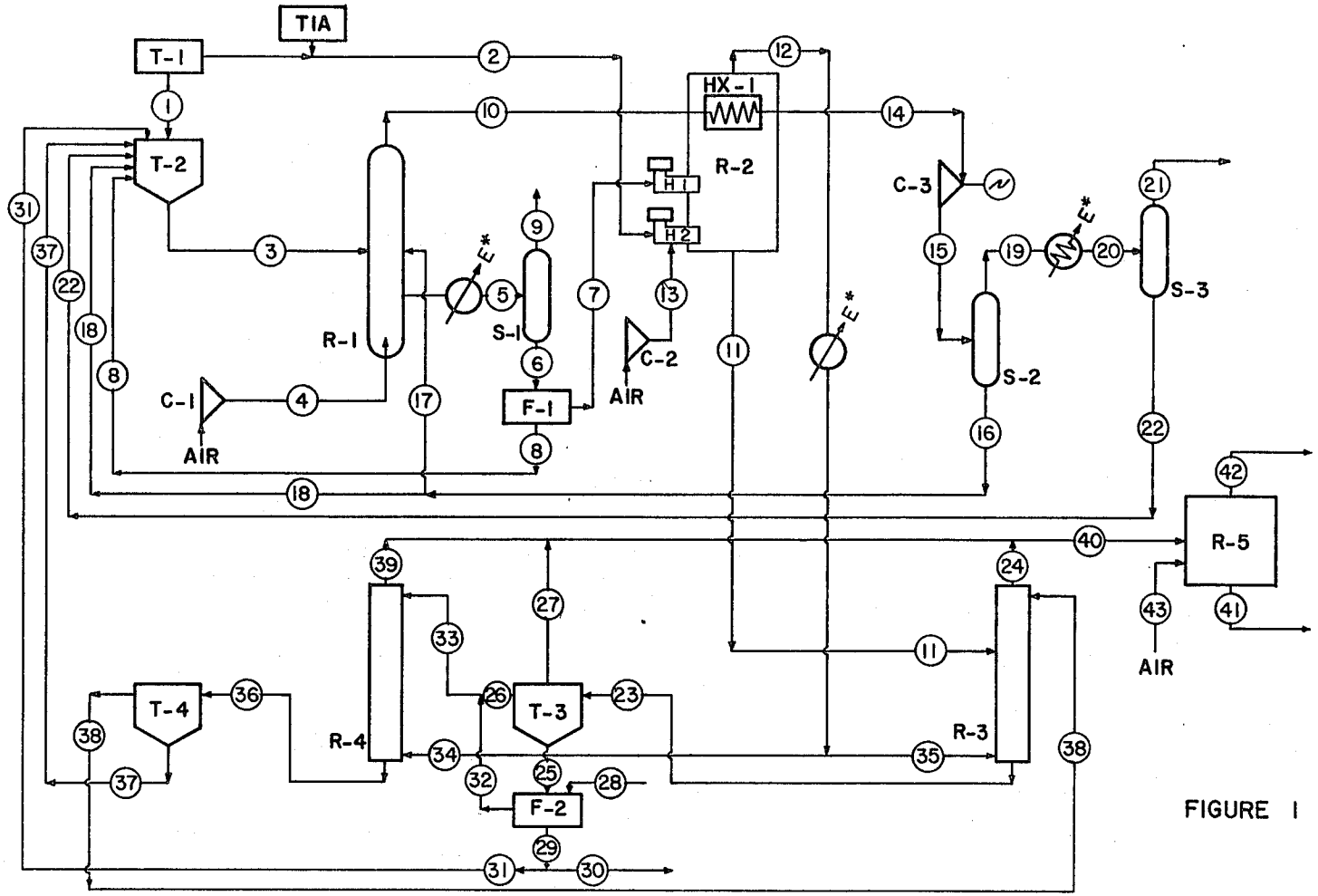
Figure 2:
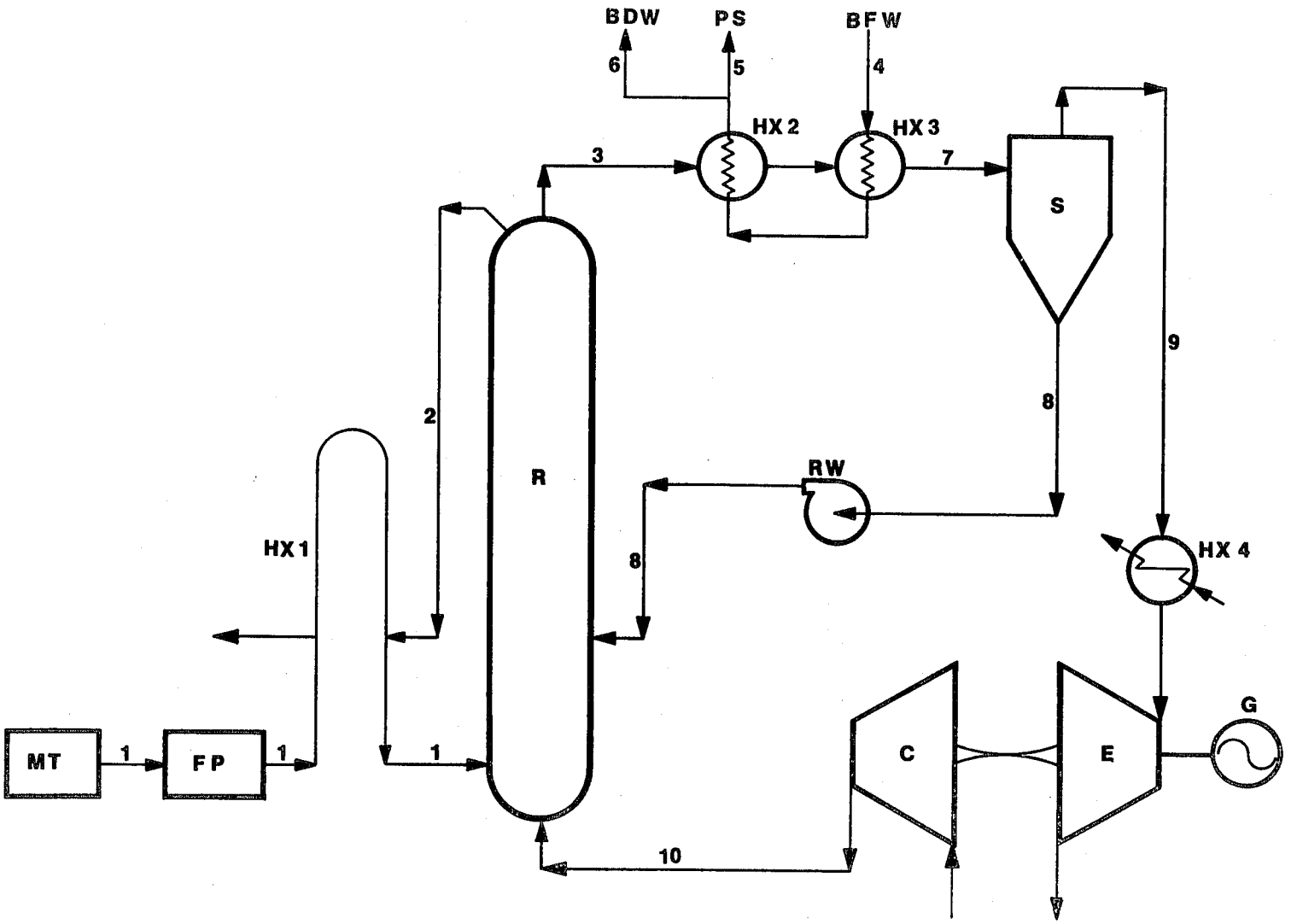

FIG. 1 is a schematic flow diagram illustrating the process of the invention; and FIG. 2 is a schematic flow diagram having particular reference to the power recovery system.

The invention can be described with particular reference to the flow diagram of FIG. 1.

The high sulfur fuel is maintained in storage tank T1. The fuel can be any of many carbonaceous high sulfur fuels such as coals, lignite, shales, tar sands, petroleum oil, refuse and the like. Such fuels will contain, for example, greater than 1% by weight sulfur. Minimal pretreatment of the crude fuel is required. If the crude fuel is a solid, it must be reduced to a particle size suitable for passage as an aqueous slurry through ordinary piping, valves and the like. Essentially no other pretreatment is required.

From storage tank T1 the crude high sulfur fuel is passed by way of line 1 to mixing tank T2. In the mixing tank an aqueous slurry is prepared of the crude fuel and the alkaline earth metal carbonate. The carbonate is provided to the mixing tank through line 37.

The alkaline earth metal carbonate should be highly insoluble, should form a substantially insoluble sulfate, should not form derivatives having melting points below the reduction temperature, and should form sulfides or hydrosulfides or sufficient solubility to be leached by water from insoluble ash. Barium and calcium carbonates are preferred. Both meet all requirements. The barium based system has an advantage in that its sulfide is more readily dissolved. Barium carbonate is somewhat more expensive than the calcium carbonate and due to its greater equivalent weight involves a greater mass per unit of fuel processed than the calcium carbonate. However, the process of the invention requires very little alkaline earth metal carbonate make up so that supply is not a problem.

The process of the invention may be controlled to overcome the somewhat greater difficulty of leaching calcium sulfide. In aqueous media the sulfide converts to hydrosulfide and hydroxide:

$$CaS + H_2O \rightarrow \tfrac{1}{2}Ca(HS)_2 + \tfrac{1}{2}Ca(OH)_2.$$

Complete dissolving of all calcium compounds is dominated by the low solubility of the hydroxide, which is only about 0.05% wt/wt. Under a slight hydrogen sulfide partial pressure the calcium hydrosulfide solubility approaches 25% wt/wt. In the instant process a side stream of carbon dioxide containing gas is diverted to the sulfide dissolution tank to create the required condition.

$$\tfrac{1}{2}Ca(HS)_2 + \tfrac{1}{2}Ca(OH)_2 + (\tfrac{1}{2}+\delta)CO_2 + \delta H_2O \rightarrow (\tfrac{1}{2}-\delta)Ca(HS)_2 + (\tfrac{1}{2}+\delta)CaCO_3 + (2\ \delta)H_2S + \tfrac{1}{2}H_2O$$

About half the calcium precipitates with the ash in this leaching step. However, a substantial fraction of the ash+calcium carbonate separated may be recycled. At least 80% may be recycled which results in a total calcium recovery of at least 90%.

Also added to the mixing tank T2 by way of line 8 is the filtrate from the wet oxidized fuel slurry. This is obtained from filter F1. Further adjustments in slurry consistency is made by recycling condensate through lines 18 and 22.

The aqueous carbonate fuel slurry is passed through line 3 to wet oxidation reaction R1.

The reactor may be of any suitable form as for example a thermally insulated self-sustaining reactor fitted with means to periodically remove sulfate and ash therefrom.

Also introduced into the reactor R1 are condensate from the power production stage (via line 17) and air from compressor C1 (via line 4). The oxygen necessary for the wet oxidation stage and supplied to R1 may be the pure gas, air (as described above) or any other oxygen containing gas mixture.

The wet oxidation occurs in R1 at a temperature of about 480° to 520° F. and a pressure of about 800 to 1400 psig with a 90 to 95% utilization of oxygen demand. Eight percent or more of the water input to R1 is converted to steam at system conditions. The balance of the water is contained in the ash and sulfate slurry blown down from the bottom of R1.

The steam and fixed gases are removed from R1 via line 10 and are conducted through heat exchanger HX1 in reducer R2 whereby the temperature is raised to about 1250° F. The superheated vapors continue via line 14 to the power generator C3.

The gas-condensate mixture from the power generator flows through line 15 to separator S2. The condensate is separated from the gases in S2 and is recycled via line 16. Most of the condensate is recycled through line 17 to reactor R1 while a portion is recycled to mixing tank T2 by line 18.

The gas exiting from separator S2 via line 19 contains substantial quantities of water vapor. The saturated gas in line 19 is cooled in HX2 to condense a major portion of the water vapor. The cooled gas-condensate mixture from HX2 flows to separator S3 by way of line 20. The gases from separator S3 are discharged via line 21 while the condensate is recycled to mixing tank T2 by way of line 22.

The ash and sulfate slurry resulting from the wet oxidation is taken off at the bottom of the reactor R1 and passed through line 5 to separator S1 and then on to filter F1 by line 6. Filtrate from F1 is recycled via line 8 to mixing tank T2. The vapors from S1 are discharged via line 9.

The symbol $\ominus\!\!\rightarrow$ E* in line 5, 12 and 19 of FIG. 1 indicates the potential for energy withdrawal from the system.

The wet ash and sulfate filter cake is passed via line 7 to lock hopper H1 for injection into reducer R2.

Reducer fuel is passed from storage tank T1 and/or T1A through line 2 to lock hopper H2. The reducer fuel can be the same as or different from the high sulfur fuel employed in the wet oxidation stage. It is not essential that the reducer fuel contain sulfur. In many cases it will be preferable that the reducer fuel be of low sulfur content. The reducer fuel may, for example, be municipal refuse which would make the process herein particularly attractive for locations where large quantities of municipal refuse are available near high sulfur fossil fuel sources.

The reducer may be any type of combustion reactor such as a rotary kiln, fluid bed furance, transport reactor, multiple hearth furnace or the like. The essential requirements for the reducer are gas tight construction and good control of fuel:oxygen ratio.

The oxygen for the reducer may be supplied as the pure gas, air, or any other oxygen containing gas mixture.

The reaction temperature in the reducer should be about 600° to 1000° C., and preferably 750° to 850° C. The reducer effluent gas must be free of oxygen.

In the embodiment shown in FIG. 1, compressed air from C2 enters lock hopper H2 via line 13 and blows the pulverized reducer fuel into reducer R2.

In the reducer R2, combustion is controlled to give an oxygen free atmosphere and raise temperatures to the necessary reaction temperatures as indicated above. In the reducer the sulfate, e.g., calcium sulfate is substantially reduced to the sulfide, e.g., calcium sulfide.

Hot gases containing steam, carbon dioxide and nitrogen leave R2 via line 12. The sulfide and ash are discharged from R2 via line 11 to reactor R3.

In R3 the sulfide and ash are mixed with hot water and a reaction to produce the hydroxide and hydrosulfide occurs. In the case of calcium sulfide this may be shown as follows:

$$CaS + H_2O = \tfrac{1}{2}Ca(HS)_2 + \tfrac{1}{2}Ca(OH)_2.$$

Sufficient hot water is circulated via line 38 through R3 to dissolve substantially all of the hydrosulfide and hydroxide. The hot slurry of dissolved hydrosulfide and hydroxide and ash is passed via line 23 to settling tank T3.

The clarified hot solution of hydrosulfide and hydroxide overflows tank T3 via line 26. Thickened slurry is passed through line 25 to filter F2 where ash is removed and solution liquor is passed through line 32 to join the main stream of hydrosulfide hydroxide solution in line 33.

A small amount of wash water is introduced to filter F2 through line 28 to purge solution from ash filter cake. Wash waters are sent to the main solution stream line 33 and washed ash is discharged via lines 29, 30, and 31.

The main stream of the hot solution of hydrosulfide and hydroxide in line 33 is passed to carbonation reactor R4. Hot vapors of steam, carbon dioxide and nitrogen from reducer R2 via line 12 and then through 34 are introduced into R4. Reaction occurs to produce hydrogen sulfide and carbonate. In the case of calcium this may be depicted as follows:

$$Ca(HS)_2 + Ca(OH)_2 + 2CO_2 \rightarrow 2CaCO_3 + 2\ H_2S.$$

The hydrogen sulfide is expelled via line 39 and then through line 40 to reactor R5 for conversion to elemental sulfur by per se well known means. Air is introduced to R5 through line 43. Elemental sulfur is recovered via line 41 while the exhaust gases are discharged through line 42.

Carbonate slurry is withdrawn from R4 via line 36 and sent to a thickening tank T4. Hot supernatant water overflows T4 via line 38 and is recycled to R3. Thickened carbonate slurry returns to mixing tank T2 via line 37.

As described earlier, the solubility of $Ca(HS)_2$ in reactor R3 can be improved substantially by maintaining a slight hydrogen sulfide partial pressure. Referring to FIG. 1 this can be done by bleeding a small portion of the carbon dioxide from reducer R2 exhaust gases in line 12 via line 35 into R3. The reaction occurring to R3 will then be:

$$\tfrac{1}{2}Ca(HS)_2\tfrac{1}{2}Ca(OH)_2 + (\tfrac{1}{2}+\delta)CO_2 + \delta H_2O \rightarrow (\tfrac{1}{2}-\delta)\ Ca(HS)_2 + (\tfrac{1}{2}+\delta)CaCO_3 + (2\delta)\ H_2SL + \tfrac{1}{2}H_2O$$

The increased solubility of $Ca(HS)_2$ under above conditions will significantly reduce water recycling through line 38. As shown above $CaCO_3$ is formed in R3 which will remain with ash and will be discharged as a filter cake from F2 via line 29. While a portion of the $CaCO_3$ will be lost through ash disposal via line 30, most of the $CaCO_3$ can be recovered by recycling $CaCO_3$ along with ash into the mixing tank T2 via line 31.

When $CO_2$ is introduced via line 35 into reactor R3, there will be some residual gases from both R3 and T3. Referring to FIG. 1, the gas from R3 and T3 will exit via lines 24 and 27 respectively and will meet with gases in line 39 and eventually flow into reactor R5 via line 40.

The wet oxidation apparatus and the associated power recovery system may, of course, take many different forms. FIG. 2 illustrates one form designed for efficient production of power. The system illustrated is only one form and is presented solely to aid in the description of the overall process. Many other designs may serve just as well for this aspect.

Referring to FIG. 2, an aqueous slurry of the high sulfur fuel and carbonate is transferred from mix tank MT via feed pump FP and line 1 through heat exchanger HX1 to the wet oxidation reactor R. Recycle water is supplied through line 8 and oxygen-containing gas is supplied through line 10 from compressor C. A reaction temperature of about 480° to 520° F. is attained. The pressure is set at about 800 to 1400 psig. Under these conditions 80 to 96% of the total water is converted to steam.

A concentrated slurry of ash and sulfate is separated internally in reactor R and discharged via line 2 through heat exchanger HX1. The heat exchange in HX1 raises the temperature of the input slurry to a level sufficient for initiation of wet oxidation reaction. The discharge ash and sulfate slurry is treated as described previously herein. Steam and fixed gases pass from reactor R through line 3 to the heat exchanger system HX2–HX3.

Water of boiler feed quality (BFW) is introduced to the heat exchange system HX2–HX3 via line 4. Process steam (PS) and blowdown water (BDW) are produced at lines 5 and 6 respectively. Saturated steam, condensate and fixed gases pass via line 7 to separator S. Condensate is separated and pumped via recycle water pump RW through line 8 back to reactor R.

Saturated steam and fixed gases from S pass via line 9 through heat exchanger HX4 which is situated in the reducing furnace (shown in FIG. 1 as reducer R2). The reducing furnace is operated at 1300° to 1700° F. The heat exchanger raises the steam gas mixture temperature from 1000° to 1400° F. This superheated mixture is delivered to expander E which is linked to compressor C and generator G.

The following example illustrates the process of the invention. This example is purely illustrative and not exhaustive of the invention. The example illustrates the processing of 1000 tons per day of a coal containing 3.2% sulfur and 12.5% ash. The quantities shown are pounds per minute.

EXAMPLE 1

The process is carried out as described above for FIG. 1. The materials quantities are as described in Table 1 below. The example illustrates the use of calcium carbonate with complete recovery of the carbonate. One hundred pounds of CaS are produced per minute. Reaction with water results in 73.7 pounds of $Ca(HS)_2$ and 51.4 pounds of $Ca(OH)_2$ per minute. About 114,000 pounds of water per minute are required to leach all calcium from the ash.

Table 1

| Stream | | 1 | 2 | 3 | 4 | 5 | 6 | 7 | 8 |
|---|---|---|---|---|---|---|---|---|---|
| Description | | Coal from T-1 to T-2 | Coal from T-1 to R-2 | Slurry from T-2 to R-1 | Air to R-1 | Ash Blowdown from R-1 to S-1 | Slurry from S-1 to F-1 | Solids from F-1 to R-2 | Filtrate Recycle from F-1 to T-2 |
| Temperature, | °F. | 68 | 68 | 130 | 283 | 500 | 228 | 140 | 140 |
| Enthalpy, | BTU/min. | 17,460 | 7,506 | 426,650 | 590,000 | 761,250 | 236,710 | 53,590 | 76,720 |
| Water Liq. | #/min. | | | 3,749 | | 1,508 | 1,088 | 377.6 | 710.4 |
| Vap. | #/min. | | | | | | | | |
| Coal | #/min. | 970 | 417 | 970 | | 97 | 97 | 97 | |
| Sulfur | #/min. | | | | | | | | |
| Ash | | | | | | 110 | 110 | 110 | |
| (Free from Coal) | | | | | | | | | |
| $CaCO_3$ | #/min. | | | 139 | | 51.8 | 51.8 | 51.8 | |
| $CaSO_4$ | #/min. | | | | | 118.6 | 118.6 | 118.6 | |
| $Ca(OH)_2$ | #/min. | | | | | | | | |
| $Ca(HS)_2$ | #/min. | | | | | | | | |
| CaS | #/min. | | | | | | | | |
| Air | #/min. | | | | 9,805 | | | | |
| $N_2$ | #/min. | | | | (7,535) | | | | |
| $O_2$ | #/min. | | | | (2,270) | | | | |
| $CO_2$ | #/min. | | | | | | | | |

Table 1-continued

| | | | | | | | | | |
|---|---|---|---|---|---|---|---|---|---|
| $H_2S$ | #/min. | | | | | | | | |
| Total Mass | #/min. | 970 | 417 | 4,860 | 9,805 | 1,885.4 | 1,465.4 | 755.0 | 710.4 |

| Stream | | 9 | 10 | 11 | 12 | 13 | 14 | 15 | 16 |
|---|---|---|---|---|---|---|---|---|---|
| Description | | Vapor from S-1 to Vent | Vapors from R-1 to R-2 | Solids from R-2 to R-3 | Gases from R-2 to R-3/R-4 | Air to R-2 | Superheated Vapors from R-2 to C-3 | Expand. Vap. C-3 to 5-2 | Cond. from S-2 |
| Temperature, | °F. | 228 | 500 | 500 | 650 | 68 | 1200 | 160 | 160 |
| Enthalpy, | BUT/min. | 485,650 | 12.8028 × $10^6$ | 31,150 | 1,15677 × $10^6$ | 41,700 | 17.9728 × $10^6$ | 3.492 × $10^6$ | 996,284 |
| Water Liq. | #/min. | | | | | | | 7,789.66 | 7,789.66 |
| Vap. | #/min. | 420.0 | 9,712.80 | | 655.16 | | 9,712.80 | 1,923.14 | |
| Coal | #/min. | | | | | | | | |
| Sulfur | #/min. | | | | | | | | |
| Ash | | | | 174.56 | | | | | |
| (Free from Coal) | | | | | | | | | |
| $CaCO_3$ | #/min. | | | | | | | | |
| $CaSO_4$ | #/min. | | | | | | | | |
| $Ca(OH)_2$ | #/min. | | | | | | | | |
| $Ca(HS)_2$ | #/min. | | | | | | | | |
| CaS | #/min. | | | 100.09 | | | | | |
| Air | #/min. | | | | | 4,827 | | | |
| $N_2$ | #/min. | | 7,535.0 | | 3,709.52 | (3,709.52) | 7,535.0 | 7,535.0 | |
| $O_2$ | #/min. | | 218.44 | | Nil | (1,117.48) | 218.44 | 218.44 | |
| $CO_2$ | #/min. | | 2,315.36 | | 1,359.67 | | 2,315.36 | 2,315.36 | |
| $H_2S$ | #/min. | | | | | | | | |
| Total Mass | #/min. | | 19,781.60 | 274.65 | 5,724.35 | 4,827.0 | 19,781.60 | 19,781.60 | 7,789.66 |

| Stream | | 17 | 18 | 19 | 20 | 21 | 22 | 23 | 24 |
|---|---|---|---|---|---|---|---|---|---|
| Description | | Cond. Recycle S-2 to R-1 | Cond. Recycle S-2 to T-2 | Vapors from S-2 | Partially Condensed Vapor to S-3 | Gases from S-3 to Vent | Cond. Recycle S-3 to T-2 | Slurry from R-3 to T-3 | Gas from R-3 |
| Temperature, | °F. | 160 | 160 | 160 | 125 | 125 | 125 | 140 | |
| Enthalpy, | BUT/min. | 895,550 | 100,734 | 2.496 × $10^6$ | 1.356 × $10^6$ | 1.2631 × $10^6$ | 92,900 | 11.886 × $10^6$ | |
| Water Liq. | #/min. | 7,002 | 787.66 | | 999.81 | | 999.81 | 109,983.97 | |
| Vap. | #/min. | | | 1,923.33 | 923.33 | 923.33 | | | |
| Coal | #/min. | | | | | | | | |
| Sulfur | #/min. | | | | | | | | |
| Ash | | | | | | | | 174.56 | |
| (Free from Coal) | | | | | | | | | |
| $CaCO_3$ | #/min. | | | | | | | | |
| $CaSO_4$ | #/min. | | | | | | | | |
| $CA(OH_2$ | #/min. | | | | | | | 51.44 | |
| $Ca(HS)_2$ | #/min. | | | | | | | 73.68 | |
| CaS | #/min. | | | | | | | | |
| Air | #/min. | | | | | | | | |
| $N_2$ | #/min. | | | 7,535.0 | 7,535.0 | 7,535.0 | | | |
| $O_2$ | #/min. | | | 218.44 | 218.44 | 218.44 | | | |
| $CO_2$ | #/min. | | | 2,315.36 | 2,315.36 | 2,315.36 | | | |
| $H_2S$ | #/min. | | | | | | | | |
| Total Mass | #/min. | 7,002 | 787.66 | 11,991.94 | 11,991.94 | 10,992.13 | 999.81 | 110,283.65 | Nil |

| Stream | | 25 | 26 | 27 | 28 | 29 | 30 | 31 | 32 | 33 |
|---|---|---|---|---|---|---|---|---|---|---|
| Description | | Thickened Slurry from T-3 to F-2 | Overflow From T-3 | Gas from T-3 | Wash Water to F-2 | Filter Cake from F-2 | Ash to Disposal | Ash Recycle F-2 to T-2 | Filtrate from F-2 | Liq. to R-4 from T-3 and F-2 |
| Temmperature, | °F. | 137.3 | 137.3 | | 68 | 122 | 122 | | 122 | 136.8 |
| Enthalpy, | BTU/min. | 349,340 | 11.235 × $10^6$ | | 19,260 | 52,000 | 52,000 | | 298,600 | 11.5336 × $10^6$ |
| Water Liq. | #/min. | 3,316.64 | 106,667.33 | | 535.0 | 535.0 | 535.0 | | 3,316.64 | 109,983.97 |
| Vap. | #/min. | | | | | | | | | |
| Coal | #/min. | | | | | | | | | |
| Sulfur | #/min. | | | | | | | | | |
| Ash | | 174.56 | | | | 174.56 | 174.56 | | | |
| (Free of Coal) | | | | | | | | | | |
| $CaCO_3$ | #/min. | | | | | | | | | |
| $CaSO_4$ | #/min. | | | | | | | | | |
| $Ca(OH)_2$ | #/min. | 1.55 | 49.89 | | | | | | 1.55 | 51.44 |
| $Ca(HS)_2$ | #/min. | 2.22 | 71.46 | | | | | | 2.22 | 73.68 |
| CaS | #/min. | | | | | | | | | |
| Air | #/min. | | | | | | | | | |
| $N_2$ | #/min. | | | | | | | | | |
| $O_2$ | #/min. | | | | | | | | | |
| $CO_2$ | #/min. | | | | | | | | | |
| $H_2S$ | #/min. | | | | | | | | | |
| Total Mass | #/min. | 3,494.97 | 106,788.68 | Nil | 535.0 | 709.56 | 709.56 | Nil | 3,320.41 | 110,109.09 |

| Stream | 34 | 35 | 36 | 37 | 38 | 39 | 40 | 41 | 42 | 43 |
|---|---|---|---|---|---|---|---|---|---|---|

Table 1-continued

| Description | | Gases from R-2 to R-4 | Gases from R-2 to R-3 | Slurry from R-4 to T-4 | Thick-ened Slurry from T-4 to T-2 | Overflow from T-4 to R-3 | Gases from R-4 to R-5 | Gas to Claus Plant R-5 | Sulfur Product from R-5 | Gases from R-5 to Vent | Air to R-5 |
|---|---|---|---|---|---|---|---|---|---|---|---|
| Tempera-ture | °F. | 650 | | 143 | 140 | 140 | 143 | 143 | 350 | 350 | 68 |
| Enthalpy, | BTU/min. | 1.15677 | 12.2 × $10^6$ | 138,875 | 11.735 | 221,315 | 221,315 | | 1.305 | | |
| | | × $10^6$ | | | | × $10^6$ | | | | × $10^6$ | |
| Water Liq. | #/min. | | | 109,909.13 | 1,251.13 | 108,658 | | | | | |
| Vap. | #/min. | 655.16 | | | | | 730 | 730 | | 755.06 | |
| Coal | #/min. | | | | | | | | | | |
| Sulfur | #/min. | | | | | | | | 44.5 | | |
| Ash (Free of Coal) | | | | | | | | | | | |
| $CaCO_3$ | #/min. | | | 139.0 | 139.0 | | | | | | |
| $CaSO_4$ | #/min. | | | | | | | | | | |
| $Ca(OH)_2$ | #/min. | | | | | | | | | | |
| $Ca(HS)_2$ | #/min. | | | | | | | | | | |
| CaS | #/min. | | | | | | | | | | |
| Air | #/min. | | | | | | | | | | 96.16 |
| $N_2$ | #/min. | 3,709,52 | | | | | 3,709.52 | 3,709.52 | | 3,783.42 | (73.9) |
| $O_2$ | #/min. | Nil | | | | | Nil | Nil | | | (22.26) |
| $CO_2$ | #/min. | 1,359.67 | | | | | 1,298.49 | | 1,298.49 | | 1.298.49 |
| $H_2S$ | #/min. | | | | | | 47.30 | 47.30 | | | |
| Total Mass | #/min. | 5,724.35 | Nil | 110,048.13 | 1,390.13 | 108,658 | 5,785.31 | 5,785.31 | 44.5 | 5,836.97 | 96.16 |

Having described the invention, what is claimed is:

1. A process for the production of power from a crude sulfur bearing fuel which comprises subjecting the crude sulfur bearing fuel to wet oxidation in the presence of an alkaline earth metal carbonate, utilizing the steam and compressed gases from the wet oxidation in power production, separating insoluble ash and sulfate salt from the wet oxidation reactor blowdown, mixing the ash and sulfate salt with a portion of the same or a different fuel, reacting the mixture at a high temperature under reducing conditions to produce the corresponding alkaline earth metal sulfide, and treating the alkaline earth metal sulfide with water and carbon dioxide to regenerate alkaline earth carbonate and release hydrogen sulfide.

2. A process according to claim 1 in which the alkaline earth metal carbonate is calcium carbonate.

3. A process according to claim 1 in which the alkaline earth metal carbonate is barium carbonate.

4. A process according to claim 1 in which the fuel used in wet oxidation and in reduction is a coal containing more than 1% sulfur.

5. A process according to claim 1 in which the fuel used in wet oxidation and in reduction is a petroleum oil containing more than 1% sulfur.

6. A process according to claim 1 in which the fuel used in wet oxidation contains more than 1% sulfur and the fuel used in reduction is sulfur free.

7. A process according to claim 1 in which the fuel used in wet oxidation contains more than 1% sulfur and the fuel used in reduction is municipal refuse.

8. A process according to claim 1 in which released hydrogen sulfide is converted to elementary sulfur.

9. A process according to claim 1 in which effluent gases from the reduction stage are used to provide carbon dioxide for conversion of alkaline earth metal sulfide to alkaline earth metal carbonate.

10. A process according to claim 1 in which the wet oxidation feed slurry of alkaline earth metal carbonate and fuel is used as a medium to scrub effluent gases.

11. A method according to claim 2 wherein up to 90% of the calcium carbonate used in the wet oxidation stage is recovered by reducing the calcium sulfate formed in the wet oxidation stage to calcium sulfide, suspending the sulfide in water, introducing sufficient carbon dioxide to create a hydrogen sulfide pressure of 10–100 mm Hg, dissolving the resulting calcium hydrosulfide at about 10–20% by weight, filtering precipitated calcium carbonate and ash, treating the hydrosulfide extract with carbon dioxide to precipitate pure calcium carbonate, and recycling all of the pure calcium carbonate plus 80% of the calcium carbonate-ash mixture.

* * * * *

UNITED STATES PATENT AND TRADEMARK OFFICE

CERTIFICATE OF CORRECTION

PATENT NO. : 4,238,322

DATED : December 16, 1980

INVENTOR(S) : Wayne B. Gitchel

It is certified that error appears in the above-identified patent and that said Letters Patent are hereby corrected as shown below:

Cover page, under [56] References Cited, column 2, "Stambough et al.", each occurrence, should read --Stambaugh et al.--; "Tipper et al." should read --Tippmer et al.--.

Column 1, line 49, "can be" should read --can then be--.

Column 2, line 5, "fuel" should read --fuels--; line 53, "or sufficient" should read --of sufficient--.

Column 3, line 40, "Eight" should read --Eighty--.

Column 5, line 23, "1/2 $Ca(HS)_2$ 1/2" should read --1/2 $Ca(HS)_2$ + 1/2--; line 24, "$H_2SL$" should read --$H_2S$--.

Column 7, Table 1-continued, under Description column, "BUT/min." should read --BTU/min.-- (Streams 9-16 and 17-24); "$CA(OH_2$" should read --$Ca(OH)_2$-- (Streams 17-24); "Temmperature" should read --Temperature-- (Streams 25-33).

UNITED STATES PATENT AND TRADEMARK OFFICE

CERTIFICATE OF CORRECTION

PATENT NO. : 4,238,922

DATED : December 16, 1980

INVENTOR(S) : Wayne B. Gitchel

It is certified that error appears in the above-identified patent and that said Letters Patent are hereby corrected as shown below:

Columns 9-10, Table 1-continued should read as follows:

| Description | | Gases from R-2 to R-4 | Gases from R-2 to R-7 | Slurry from R-4 to T-4 | Thickened Slurry from T-4 to T-2 | Overflow from T-4 to R-3 | Gases from R-4 to R-5 | Gas to Claus Plant R-5 | Sulfur Product from R-5 | Gases from R-5 to Vent | Air to R-5 |
|---|---|---|---|---|---|---|---|---|---|---|---|
| Temperature, °F | | 650 | | 143 | 140 | 140 | 143 | 143 | 350 | 350 | 68 |
| Enthalpy, BTU/min. | | $1.15677 \times 10^6$ | | $12.2 \times 10^6$ | 136,875 | $11.735 \times 10^6$ | 221,315 | 221,315 | | $1.305 \times 10^6$ | |
| Water Liq. | #/min. | | | 109,909.13 | 1,251.13 | 108,658 | | | | | |
| Vap. | #/min. | 855.16 | | | | | 730 | 730 | | 765.06 | |
| Coal | #/min. | | | | | | | | 44.5 | | |
| Sulfur | #/min. | | | | | | | | | | |
| Ash(Free of Coal) | | | | | | | | | | | |
| $CaCO_3$ | #/min. | | | 139.0 | 139.0 | | | | | | |
| $CaSO_4$ | #/min. | | | | | | | | | | |
| $Ca(OH)_2$ | #/min. | | | | | | | | | | |
| $Ca(HS)_2$ | #/min. | | | | | | | | | | |
| CaS | #/min. | | | | | | | | | | 96.16 |
| Air | #/min. | | | | | | | | | | (73.9) |
| $N_2$ | #/min. | 3,709.52 | | | | | 3,709.52 | 3,709.52 | | 3,783.42 | (22.26) |
| $O_2$ | #/min. | Nil | | | | | Nil | Nil | | | |
| $CO_2$ | #/min. | 1,359.67 | | | | | 1,298.49 | 1,298.49 | | 1,298.49 | |
| $H_2S$ | #/min. | | | | | | 47.30 | 47.30 | | | |
| Total Mass | #/min. | 5,724.35 | Nil | 110,048.13 | 1,390.13 | 108,658 | 5,785.31 | 5,785.31 | 44.5 | 5,836.97 | 96.16 |

Signed and Sealed this

Fifth Day of May 1981

[SEAL]

Attest:

RENE D. TEGTMEYER

Attesting Officer

Acting Commissioner of Patents and Trademarks